United States Patent [19]

Higashi et al.

[11] Patent Number: 4,713,216

[45] Date of Patent: Dec. 15, 1987

[54] ALUMINUM ALLOYS HAVING HIGH STRENGTH AND RESISTANCE TO STRESS AND CORROSION

[75] Inventors: Kenji Higashi; Tadakazu Ohnishi; Ichizo Tsukuda, all of Osaka, Japan

[73] Assignee: Showa Aluminum Kabushiki Kaisha, Osaka, Japan

[21] Appl. No.: 854,777

[22] Filed: Apr. 22, 1986

[30] Foreign Application Priority Data

Apr. 27, 1985 [JP] Japan ..... 60-91840
Aug. 22, 1985 [JP] Japan ..... 60-185472
Mar. 7, 1986 [JP] Japan ..... 61-51078

[51] Int. Cl.[4] ..... C22C 21/10
[52] U.S. Cl. ..... 420/532; 420/541

[58] Field of Search ..... 420/532, 541; 148/439, 148/440

[56] References Cited

U.S. PATENT DOCUMENTS 4,141,725 2/1979 Murai et al. ..... 420/541

*Primary Examiner*—R. Dean
*Attorney, Agent, or Firm*—Collard, Roe & Galgano

[57] ABSTRACT

An aluminum alloy having excellent properties including extrusibility, forgeability and malleability, the alloy containing 4.0 to 12% of zinc, 0.3 to 5.0% of magnesium, and one or more elements selected from the rare earth elements, wherein the content of the selected element is in the range of 0.5 to 10.0%, and the balance being substantially aluminum and unavoidable impurities.

14 Claims, No Drawings

ALUMINUM ALLOYS HAVING HIGH STRENGTH AND RESISTANCE TO STRESS AND CORROSION

BACKGROUND OF THE INVENTION

1. Field of the Invention

The present invention relates to aluminum alloys suitable for use as machine or construction materials, and more particularly to an Al-Zn-Mg alloy having excellent properties, such as extrusibility, malleability and forgeability, which are essential as machine and construction materials.

In this specification the alloy contents are indicated in terms of per cent by weight.

2. Description of the Prior Art

Of the AA7000 alloys, namely aluminum-zinc-magnesium alloys, the 7003 alloy is known for its strength, extrusibility and forgeability. Of a variety of aluminum alloys including the 7000 alloys the 7075 alloy is well known for its strength and malleability. Nevertheless, the 7003 alloys lack the extrusibility, and the 7075 alloys lack the malleability for practical purposes.

Recently every industrial field requires thin, lightweight sheet materials. In order to enhance the strength of alloys without trading off their extrusibility and malleability, the common practice is to add more zinc or magnesium. However, the addition of zinc makes the alloy susceptible to stress and corrosion. As a result such alloys become unsuitable for construction.

An excessive amount of magnesium tends to impair the malleability, and make it hard, thereby reducing the workability of the alloy. The 7075 alloy per se is susceptible to stress and corrosion, and therefore it is necessary to heat it to a higher temperature, and then temper it for a longer period of time than for $T_6$-alloy, so as to stabilize the structure and attain as tempered a state as the $T_7$-alloys. Owing to this special heat treatment the strength is unavoidably sacrified by 10 to 20%.

After all it is difficult to obtain aluminum alloys having sufficient strength, resistance to stress and corrosion, and being excellent in extrusibility, forgeability and workability.

OBJECTS AND SUMMARY OF THE INVENTION

The present invention aims at solving the problems pointed out with respect to the known aluminum alloys, and has for its object to provided an Al-Zn-Mg content alloy, commonly called the 7000 Al-Zn-Mg alloys, being improved in resistance to stress and corrosion without trading off its inherent properties including extrusibility, malleability and forgeability.

Another object of the present invention is to provide an Al-Zn-Mg content alloy being particularly excellent in extrusibility and malleability.

A further object of the present invention is to provide an Al-Zn-Mg content alloy less susceptible to the welding heat, thereby keeping it free from cracking.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided an aluminum alloy which contains 4 to 12% of zinc, 0.3 to 5.0% of magnesium, and one or more elements selected from the rare earth elements, wherein the content of the selected element is in the range of 0.5 to 10.0%, and the balance being substantially aluminum and unavoidable impurities.

DETAILED DESCRIPTION OF THE INVENTION

In general zinc is added to increase the strength of aluminum alloys. However if the zinc content is less than 4% the desired strength is not achieved, and if it exceeds 12% the strength remains the same, thereby resulting in the waste of zinc. This means that 4 to 12% is an optimum range, of which it has been found that the range of 7.0 to 10.0% is most effective to enhance the strength of alloys.

Magnesium is also effective to increase the strength of aluminum alloys. In order to make it as tough as the 7000 alloy the magnesium content must be 0.3% or more, but if it exceeds 5.0%, no substantial effects result. On the contrary, the malleability, extrusibility, elongation and workability are likely to reduce owing to the excessive amount of magnesium. It has been found that 0.3 to 5.0% is an optimum range. When the extrusibility, malleability and workability are to be improved at the sacrifice of strength to some degree, the magnesium content is preferably adjusted to 0.3 to 2.5%. Whereas, if the strength has a priority over the other properties, its content is adjusted to 2.5 to 5.0%.

The rare earth elements used in the present invention are La, Ce, Pr, Nd, Pm, Sm, Eu, Gd, Tb, Dy, Ho, Er, Tm, Yb and Lu, plus Sc and Y. The element can be singly used or a misch metal obtained through electrolysis of a chloride of rare earth elements can be used. Preferably one or two elements selected from the group consisting of Y, La, Ce, Pr, Nd and Sm can be singly or jointly used. The rare earth elements contained in the aluminum alloys of the invention is conducive to improving the resistance to stress and corrosion. In this regard each element works as an equivalent to produce the effects achievable by the present invention. For application one element is singly used or two or more elements are used in combination. However, if the content is less than 0.5%, the desired resistance to stress and corrosion will not be achieved, whereas if it exceeds 10%, the resistance thereto remains the same, thereby wasting the elements. On the contrary crystallization occurs in a rather rough state in the alloy, thereby reducing the strength. The content of rare earth elements is preferably limited to 0.5 to 10.0%. In this permissible range 2.0 to 7.0%, more preferably 4.0 to 6.0%, is effective to achieve a high resistance to stress and corrosion.

The rare earth elements are effective to increase and stabilize the resistance to stress and corrosion, and the crystalline structure of the alloy. In addition, the hot extrusibility and malleability are improved.

Aluminum alloys of the present invention can be applied for a wide variety of applications on account of its enhanced extrusibility, malleability and workability. In addition, by adding 7.0 or more of zinc, and 2.5% or more of magnesium the strength thereof is advantageously increased.

Copper is also effective to increase the strength of alloys, but if the content thereof is less than 0.05%, no effects will result. Whereas, if it exceeds 2.0%, the strength will reduce, and additionally the susceptibility to cracking in welding and corroding is increased. Annealing becomes difficult. Therefore, an optimum range is 0.05 to 0.7% in which the greater part of copper is added the more the strength is enhanced. However it is recommendable to add no copper at all, or alternatively to limit the amount to 0.05% to 0.7%.

Under the present invention magnesium, chromium and zirconium are added to make the crystalline granules minute during heat treatment. However, if the Mn content is less than 0.1%; the Cr content is less than 0.05% and the Zr content is less than 0.05%, no desired effect will result. If the Mn content exceeds 0.8%; the Cr content does 0.3%, and Zr content does 0.25%, rough crystals will be brought into being in the structure of the alloy, thereby reducing the strength thereof. Titanium also makes the crystalline granules minute, so that the alloy is protected against cracking when it is used for molding. Nevertheless if the content exceeds 0.1%, rough crystals will be equally brought into being, thereby reducing the strength of alloy.

The production of aluminum alloys is carried out by the known methods.

The present invention will be better understood by the following examples:

EXAMPLE 1

The aluminum alloys identified by Nos. 1 to 15 in Table (1), each alloy containing different contents, were molded into billets each having a diameter of 3 inches by the use of a water-cooled mold. Each billet was subjected to an equalizing treatment at 460° C. for 12 hours. Then it was extruded into a flat rod having a cross-sectional area of 3 mm×3 mm.

TABLE (1)

| No. | CHEMICAL COMPOSITION (% by weight) | | | | | | | | | | | | |
|---|---|---|---|---|---|---|---|---|---|---|---|---|---|
| | Al | Zn | Mg | Cu | Mn | Cr | Zr | Y | La | Ce | Pr | Nd | Sm |
| Alloys of the Invention | | | | | | | | | | | | | |
| 1 | Bl. | 8.1 | 0.9 | — | — | — | — | 2.4 | — | — | — | — | — |
| 2 | " | 4.5 | 0.5 | — | 0.4 | — | — | 5.6 | — | — | — | — | — |
| 3 | " | 8.5 | 1.1 | 0.2 | — | — | — | 2.1 | 4.5 | — | — | — | — |
| 4 | " | 10.5 | 0.5 | — | — | 0.1 | — | 4.5 | 1.2 | 2.4 | — | — | — |
| 5 | " | 7.9 | 0.5 | — | — | — | — | — | 5.3 | — | — | — | — |
| 6 | " | 8.3 | 1.0 | 0.4 | — | — | 0.13 | — | — | 7.8 | — | — | — |
| 7 | " | 6.2 | 0.7 | — | — | — | — | — | — | — | 2.1 | — | — |
| 8 | " | 8.1 | 0.9 | — | — | — | — | — | — | — | — | 5.9 | — |
| 9 | " | 8.0 | 0.8 | — | — | — | — | — | — | — | — | — | 6.3 |
| 10 | " | 8.1 | 0.8 | — | — | — | — | — | — | — | 2.8 | 3.5 | — |
| 11 | " | 4.5 | 1.2 | — | — | — | — | — | 2.1 | 4.7 | — | — | — |
| 12 | " | 5.5 | 0.8 | 1.5 | — | — | — | — | — | — | 7.2 | — | — |
| Comparative alloys | | | | | | | | | | | | | |
| 13 | " | 8.2 | 0.9 | — | 0.4 | 0.1 | — | — | — | — | — | — | — |
| 14 | " | 8.5 | 0.8 | 0.3 | — | — | 0.15 | — | — | — | — | — | — |
| 15 | " | 8.1 | 0.5 | — | — | — | — | — | — | — | — | — | — |
| 16 | " | 4.7 | 1.6 | — | 0.4 | — | 0.15 | — | — | — | — | — | — |
| 17 | " | 5.6 | 2.3 | 1.6 | — | 0.2 | — | — | — | — | — | — | — |

(*) Bl. is short for the balance.

The extrusibility of each billet was measured by the maximum extruding speed. Each extruded piece was then heated at 460° C. for two hours, and placed in water in its molten state. Finally each piece was subjected to seasoning at 120° C. for twenty-four hours. In this way a $T_6$-alloy was obtained. Table (2) shows that the $T_6$-alloys were tested with respect to extrusibility, resistance to stress and corrosion, and elongation.

TABLE 2

| No. | Extrusibility | Resistance to stress and corrosion (days) | Tensile strength (kgf/mm$^2$) |
|---|---|---|---|
| Alloys of the Invention | | | |
| 1 | 60 | 30 or more | 45.6 |
| 2 | 80 | " | 23.5 |
| 3 | 60 | " | 46.2 |
| 4 | 80 | " | 31.3 |
| 5 | 80 | " | 29.4 |
| 6 | 60 | " | 46.5 |
| 7 | 70 | " | 35.2 |
| 8 | 60 | " | 43.3 |
| 9 | 70 | " | 42.9 |
| 10 | 70 | " | 43.1 |
| 11 | 60 | " | 43.5 |
| 12 | 70 | " | 37.8 |
| Comparative alloys | | | |
| 13 | 60 | 0.5 | 44.2 |
| 14 | 60 | 0.7 | 43.9 |
| 15 | 60 | 0.7 | 29.6 |

Each test piece was compared with the AA6063 alloy, which is accepted as typical of the extruded alloys, and the figures indicate relative values when the maximum extruding speed is presupposed to be 100. The tests on the resistance to stress and corrosion was conducted by applying a load of 20 kgf/mm$^2$ in the direction of rolling or extrusion, and counting how many days it took before cracks occurred.

As evident from Table 2 the alloys of the present invention contain a high percentage of zinc, and a lower percentage of magnesium. They are strong sufficiently for practical purposes, and exhibits excellent extrusibility and resistance to stress and corrosion, as compared with the known alloys containing no rare earth elements. In addition, the crystalline granules are more minute than the comparative alloys. Annealing and welding are readily applicable to the alloys of the present invention.

EXAMPLE (2)

The alminum alloys identified by Nos. 1 to 10 and Nos. 13 and 14 were molded into plates of 5 mm thick and 150 mm wide by using a water-cooled mold. Then each plate was rolled to 3 mm thick at 450° C.

The elongation was measured in terms of the frequencies of the press passing on each test piece, which are shown in Table (3). Each piece was subjected to heat treatment, and molded into a $T_6$-alloy, which was examined with respect to resistance to stress and corrosion, and elongation. The test results are shown in Table (3):

TABLE (3)

| No. | Malleability | Resistance to stress and corrosion (days) | Tensile strength (kgf/mm$^2$) |
|---|---|---|---|
| Alloys of the Invention | | | |
| 1 | 4 | 30 or more | 45.6 |
| 2 | 3 | " | 23.7 |
| 3 | 4 | " | 45.9 |
| 4 | 3 | " | 33.1 |
| 5 | 3 | " | 29.0 |
| 6 | 4 | " | 46.5 |
| 7 | 4 | " | 34.3 |
| 8 | 4 | " | 42.9 |
| 9 | 4 | " | 43.0 |
| 10 | 4 | " | 43.4 |
| Comparative alloys | | | |
| 16 | 6 | 25 | 46.5 |
| 17 | 8 | 25 | 57.4 |

EXAMPLE (3)

The aluminum alloys identified by Nos. 18 to 26 in Table (4) were molded into billets each having a diameter of 6 inches. Then each billet was subjected to an equalizing treatment at 460° C. for sixteen hours, and extruded into a flat rod of 20 mm thick and 50 mm wide at 450° C. Finally each piece was heated at 460° C. for twelve hours, and after having been placed in water, it was subjected to seasoning at 120° C. for twenty-four hours.

TABLE (4)

| No. | CHEMICAL COMPOSITION (% by weight) | | | | | | | | | | | | | |
|---|---|---|---|---|---|---|---|---|---|---|---|---|---|---|
| | Al | Zn | Mg | Cu | Mn | Cr | Zr | Ti | Y | La | Ce | Nd | Sm | Pr |
| Alloys of the Invention | | | | | | | | | | | | | | |
| 18 | Bl. | 7.2 | 3.1 | 1.2 | — | — | — | 0.01 | 4.9 | — | — | — | — | — |
| 19 | " | 8.1 | 2.7 | 0.3 | 0.6 | — | — | 0.01 | — | 5.5 | — | — | — | — |
| 20 | " | 9.5 | 3.6 | — | — | 0.2 | — | 0.01 | — | — | 6.1 | — | — | — |
| 21 | " | 9.1 | 2.9 | — | — | — | 0.2 | 0.01 | — | — | — | 7.0 | — | — |
| 22 | " | 4.7 | 3.0 | — | — | — | — | 0.01 | — | — | — | — | 4.9 | — |
| 23 | " | 8.0 | 2.9 | — | 0.4 | — | 0.1 | 0.01 | — | — | — | — | — | 5.1 |
| 24 | " | 7.6 | 3.5 | 0.5 | — | — | — | — | — | 2.2 | 4.5 | — | — | — |
| Comparative alloys | | | | | | | | | | | | | | |
| 25 | " | 7.5 | 3.0 | 2.1 | — | 0.2 | — | — | — | — | — | — | — | — |
| 26 | " | 6.9 | 2.7 | 2.0 | — | 0.2 | — | — | — | — | — | — | — | — |

(*)Bl. is short for the balance.
The comparative alloy No. 25 is an equivalent to the 7001 alloy.
The comparative alloy No. 26 is an equivalent to the 7078 alloy.

Each test piece was subjected to heat treatment, and shaped into a $T_6$-alloy, which was examined with respect to mechanical properties and resistance to stress and corrosion. The results are shown in Table (5).

TABLE (5)

| No. | Mechanical Properties | | | Resistance to stress and corrosion (days) |
|---|---|---|---|---|
| | Tensile strength (kgf/mm$^2$) | 0.2% resistance to stress (kgf/mm$^2$) | Elongation (%) | |
| Alloys of the Invention | | | | |
| 18 | 72 | 66 | 9 | 30 days or more |
| 19 | 55 | 49 | 14 | 30 days or more |
| 20 | 57 | 50 | 14 | 30 days or more |
| 21 | 56 | 50 | 14 | 30 days or more |
| 22 | 52 | 48 | 15 | 30 days or more |
| 23 | 56 | 49 | 14 | 30 days or more |
| 24 | 57 | 50 | 14 | 30 days or more |
| Comparative alloys | | | | |
| 25 | 70 | 61 | 9 | 2 |
| 26 | 63 | 57 | 12 | 4 |

As evident from Table 5, aluminum alloys containing a high percentage of magnesium, whether it may be an aluminum-zinc-magnesium alloy or an aluminum-zinc-magnesium-copper alloy, are inherently highly strong, and are remarkably excellent in its resistance to stress and corrosion, as compared with the known AA7001 and AA7078 alloys.

What is claimed is:

1. An aluminum alloy having excellent properties including high resistance to stress and corrosion, the alloy consisting essentially of 4.0 to 12% of zinc, 0.3 to 5.0% of magnesium, and one or more elements selected from the rare earth elements, wherein the content of the selected element is in the range of 0.5 to 10.0%, and the balance being substantially aluminum and unavoidable impurities.

2. An aluminum alloy as defined in claim 1, further containing 0.05 to 2.0% of copper.

3. An aluminum alloy as defined in claim 1, further containing manganese, chromium, zirconium or titanium singly or in combination, wherein the manganese content is 0.1 to 0.8%, the chromium content is 0.05 to 0.30%, the zirconium content is 0.05 to 0.25%, and the titanium content is less than 0.1%.

4. An aluminum alloy as defined in claim 2, further containing manganese, chromium, zirconium or titanium singly or in combination, wherein the manganese content is 0.1 to 0.8%, the chromium content is 0.05 to 0.30%, the zirconium content is 0.05 to 0.25%, and the titanium content is less than 0.1%.

5. An aluminum alloy as defined in claim 1, wherein the zinc content is limited to 7.0 to 10.0% so that the strength is enhanced.

6. An aluminum alloy as defined in claim 2, wherein the zinc content is limited to 7.0 to 10.0% so that the strength is enhanced.

7. An aluminum alloy as defined in claim 1, wherein the mangnesium content is limited to 0.3 to 2.5% so that the extrusibility and malleability are enhanced.

8. An aluminum alloy as defined in claim 2, wherein the mangnesium content is limited to 0.3 to 2.5% so that the extrusibility and malleability are enhanced.

9. An aluminum alloy as defined in claim 1, wherein the mangnesium content is limited to 2.5 to 5.0% so that the extrusibility and malleability are and corrosion are enhanced.

10. An aluminum alloy as defined in claim 2, wherein the magnesium content is limited to 2.5 to 5.0% so that the strength and resistance to stress and corrosion are enhanced.

11. An aluminum alloy as defined in claim 1, wherein the rare earth element content is limited to 2.0 to 7.0% so that the resistnace to stress and corrosion is enhanced.

12. An aluminum alloy as defined in claim 2, wherein the rare earth element content is limited to 2.0 to 7.0% so that the resistance to stress and corrosion is enhanced.

13. An aluminum alloy as defined in claim 2, wherein copper content is limited to 0.05 to 0.7% so that the weldability is enhanced.

14. An aluminum alloy as defined in claim 1, wherein the rare earth element is yttrium, lanthanum, cerium, praseodymium, neodymium or samarium.

* * * * *